United States Patent [19]

Fürholz

[11] Patent Number: 4,879,203

[45] Date of Patent: Nov. 7, 1989

[54] PROCESS FOR PRODUCING MASKED POSITIVE COLOR IMAGES BY THE SILVER DYE BLEACH PROCESS

[75] Inventor: Urs J. Fürholz, Marly, Switzerland

[73] Assignee: Ciba-Geigy AG, Basel, Switzerland

[21] Appl. No.: 177,344

[22] Filed: Apr. 4, 1988

[30] Foreign Application Priority Data

Apr. 6, 1987 [CH] Switzerland ..... 1313/87

[51] Int. Cl.[4] ..... G03C 5/52; G03C 7/04

[52] U.S. Cl. ..... 430/378; 430/359; 430/406; 430/431; 430/559; 430/462; 430/502

[58] Field of Search ..... 430/378, 940, 502, 406, 430/394, 409, 494, 596, 359, 431, 462, 559

[56] References Cited

U.S. PATENT DOCUMENTS

| | | | |
|---|---|---|---|
| 2,507,154 | 5/1950 | Glass et al. | 430/378 |
| 3,227,552 | 1/1966 | Whitmore | 430/378 |
| 3,650,739 | 3/1972 | Marthaler et al. | 96/20 |
| 3,743,506 | 7/1973 | Boragine et al. | 96/73 |
| 3,754,915 | 8/1973 | Oetiker et al. | 96/53 |
| 4,046,566 | 9/1977 | Marthaler | 96/7 |
| 4,197,123 | 4/1980 | Oetiker et al. | 430/360 |
| 4,324,855 | 4/1982 | Oishi et al. | 430/378 |
| 4,440,851 | 4/1984 | Tosaka et al. | 430/378 |
| 4,636,457 | 1/1987 | Valbusa et al. | 430/378 |

OTHER PUBLICATIONS

J. K. Choletter and G. R Isselhard "Research Disclosure", May 1978, 10–11.

Mason, Photographic Processing Chemistry, Focal Press, 1975, pp. 37–39.

Glafkides, Photographic Chemistry, vol. 1, 1958, Fountain Press, pp. 60–61.

*Primary Examiner*—Paul R. Michl

*Assistant Examiner*—Thorl Chea

*Attorney, Agent, or Firm*—Wenderoth, Lind & Ponack

[57] ABSTRACT

A process for producing masked positive color images by the silver dye bleach process using a developer solution which contains 0.3 to 1.0 mol/l of a bromide.

11 Claims, 2 Drawing Sheets

FIG.1A: GRAY WEDGE
FIG.1B: BLUE WEDGE (G REPRESENTS THE Y-CURVE OF THE GRAY WEDGE OF FIG.1A)
FIG.1C: GREEN WEDGE
FIG.1D: RED WEDGE

FIG.2A: GRAY WEDGE
FIG.2B: BLUE WEDGE (G REPRESENTS THE Y-CURVE OF THE GRAY WEDGE OF FIG.2A)
FIG.2C: GREEN WEDGE
FIG.2D: RED WEDGE

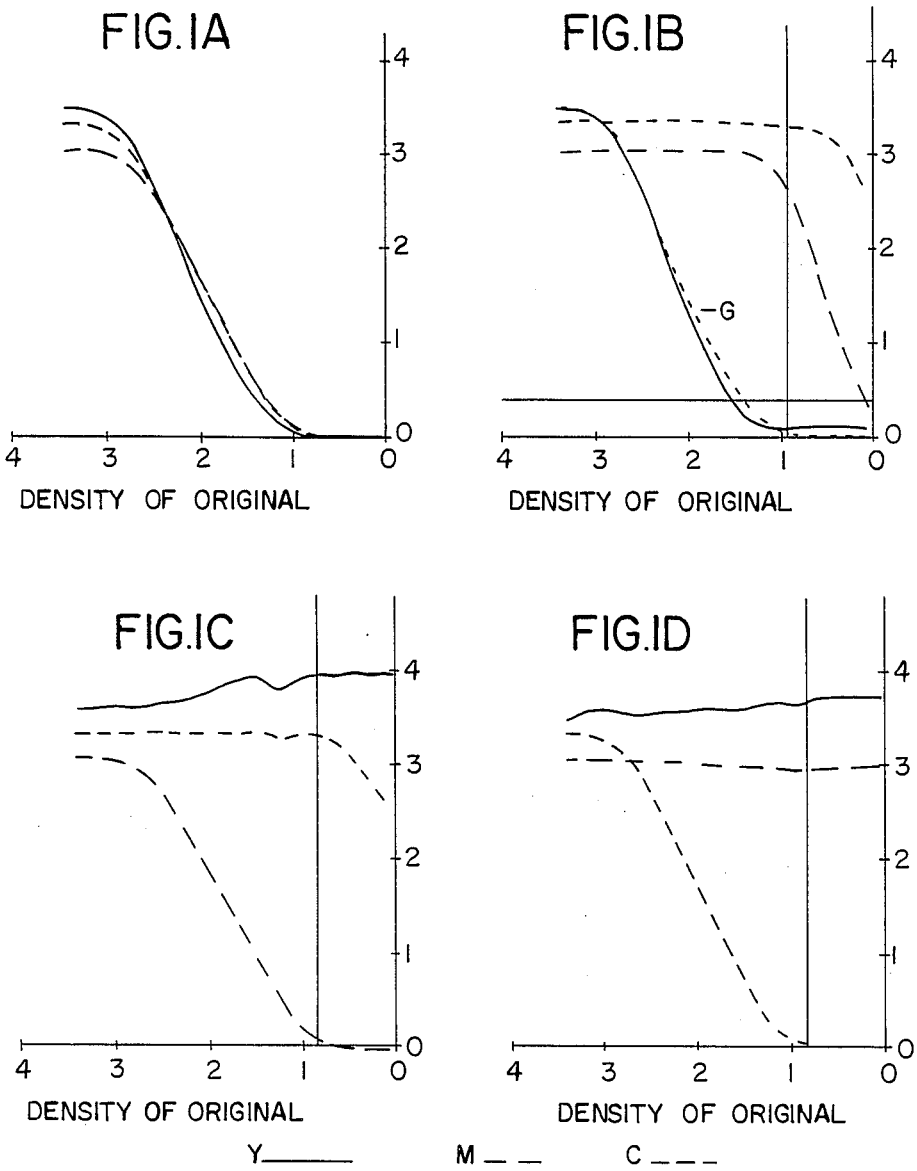
FIG.IA: GRAY WEDGE
FIG.IB: BLUE WEDGE (G REPRESENTS THE Y-CURVE OF THE GRAY WEDGE OF FIG.IA)
FIG.IC: GREEN WEDGE
FIG.ID: RED WEDGE

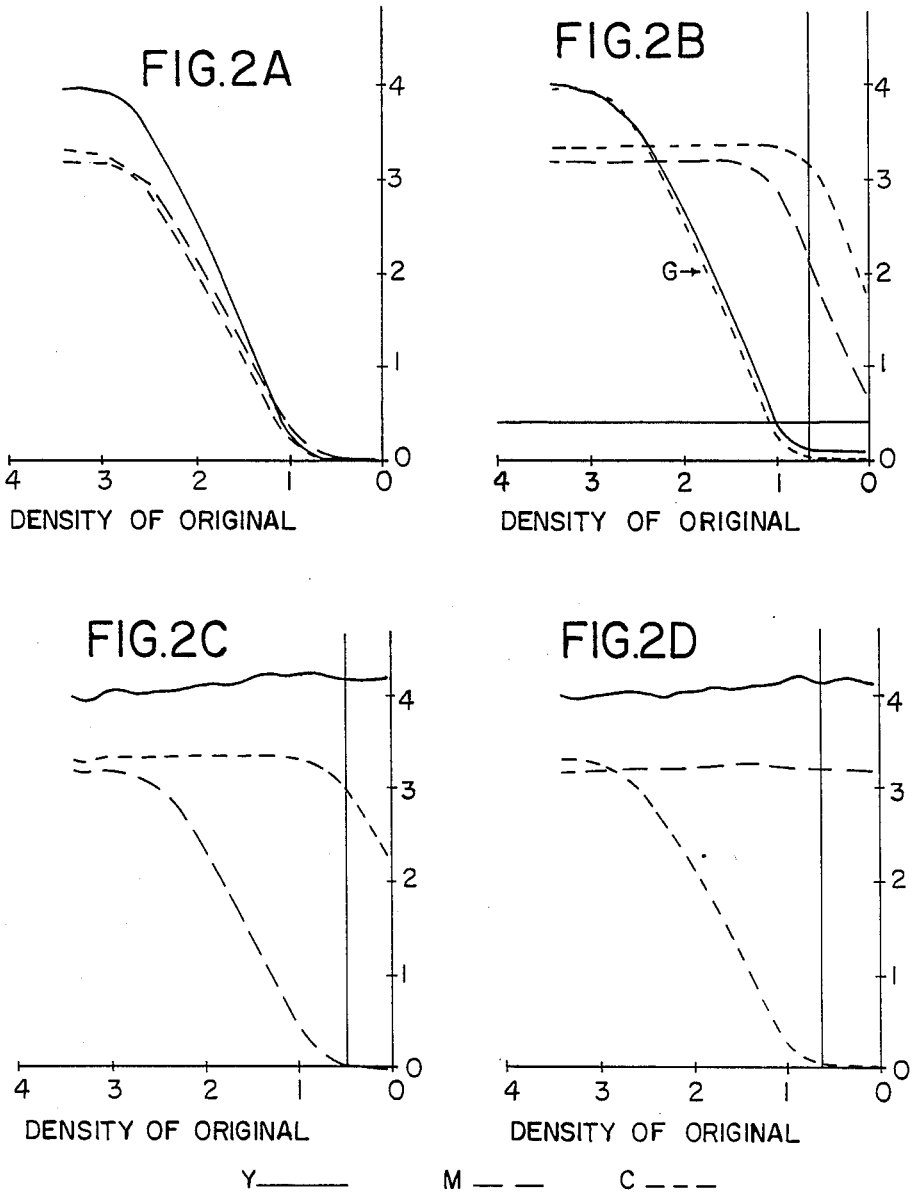
FIG2A: GRAY WEDGE
FIG.2B: BLUE WEDGE (G REPRESENTS THE Y-CURVE OF THE GRAY WEDGE OF FIG.2A)
FIG2C: GREEN WEDGE
FIG2D: RED WEDGE

PROCESS FOR PRODUCING MASKED POSITIVE COLOR IMAGES BY THE SILVER DYE BLEACH PROCESS

The present invention relates to a process for producing masked positive colour images by the silver dye bleach process.

The DE-A No. 2,547,720 has already disclosed such a process. This process comprises associating, in a silver dye bleach material having several colour layers absorbing in different spectral regions, one or more of these colour layers, the principal colour density of which corresponds to a secondary absorption to be corrected in another layer, with an iodide-free or low-iodide silver halide emulsion and providing in the immediate vicinity a layer with colloidal nuclei suitable for physical silver development, while at the same time those colour layers, the undesired secondary absorption of which is to be masked, are associated with iodide-containing silver halide emulsions. When such a system, after appropriate imagewise exposure, is treated with a developer which contains a silver halide complex former, an enrichment of silver takes place by physical development in the nuclei-containing layer adjacent to the first-mentioned layer, and this enrichment causes, in the subsequent processing stage of dye bleach, an additional dye bleach in the adjacent colour layer due to the remote bleaching effect described in DE-A Nos. 2,036,918, 2,132,836 and 2,132,835. In the case of simultaneous partial exposure of the iodide-containing emulsions associated with the other colour layers, a release and migration of iodide ions takes place during the silver development. In a manner known per se, these ions inhibit the physical development in the nuclei layer and form therein a mask image which is the reverse of the negative images formed in the iodide-containing emulsion layers. In the quoted DE-A No. 2,547,720, it has been described in detail how this mask image controlled by several layers can be exploited for producing a number of different masking effects and how the process can be used for producing images of improved colour rendering.

According to the teaching given in DE-A No. 2,831,814, this process can be yet further improved by also adding a relatively insensitive, iodide-free silver halide emulsion and, if appropriate, a development inhibitor to the layer containing the colloidal nuclei.

It has already been mentioned that the development stage in the said processes requires the presence of silver complex formers. Salts of thiocyanic acid and above all of thiosulfuric acid, especially sodium thiosulfate, are described as examples of such complex formers.

Developer solutions containing such complex formers have, however, the disadvantage that the soluble silver complexes, which are enriched in the exposed materials during the development thereof, are not stable under the prevailing reducing conditions. These silver complexes are gradually reduced to metallic silver which deposits in the form of an interfering silver sediment. This silver sediment can adhere to the photographic materials which are to be developed and can produce stains therein or deposit on parts of the development apparatus, which is a great disadvantage, especially in apparatuses operating continuously.

It is therefore the object of the present invention to modify the developing step described in the processes according to DE-A Nos. 2,547,720 and 2,831,814 in such a way that the formation of silver sediment in the developer solution does not take place.

According to the invention, this object is achieved by using bromides in a high concentration as the silver complex formers in the developer solution.

It is highly surprising that high concentrations in bromide in developer solutions give good results. In fact, it had to be assumed hitherto, for example according to P. Glafkides, Photographic Chemistry, volume 1, page 60, 1958, Fountain Press, that even concentrations of more than 2 g of potassium bromide per liter of developer solution can cause noticeable delays in development, while at the same time the sensitivity of the emulsion to be developed decreases and the contrast increases. These changes, both in the developer solution and in the treated emulsion, are of course undesirable. According to L. F. A. Mason, in Photographic Processing Chemistry, Page 37, Focal Press, 1975, the usual quantity of potassium bromide in a developer solution is between 1 and 15 g/l, i.e. of the order of magnitude of about 0.01 to 0.1 mol/l, whereas, in the processes according to DE-A Nos. 2,547,720 and 2,831,814, the development is carried out in each case in the presence of only 2 g/l of potassium bromide (0.016 mol).

Very surprisingly, however, it has now been found that, contrary to the teachings given in this state of the art, even far higher concentrations of up to 1 mol/l of bromide can be used in developer solutions. In a surprisingly simple manner, this gives stable developer solutions in which virtually no silver deposits are formed, even after prolonged use.

As compared with the colour images produced by the processes according to DE-A Nos. 2,547,720 and 2,831,814, those produced by the process according to the invention do not show any differences in quality. The masking effect is equally good in all cases.

The present invention thus relates to a process for producing masked positive colour images by the silver dye bleach process by exposure, development, dye bleaching, silver bleaching and fixing, with the use of a photographic material which, in each of at least two layers, contains a dye which can be bleached imagewise and the absorption maximum of which corresponds in each case to one of the three principal colours red, green and blue, each dye being associated with a silver halide emulsion layer sensitive in a defined spectral region and, in this material, (a) the dye, the undesired secondary colour density of which is to be compensated, being associated with a silver halide emulsion layer consisting at least partially of silver iodide, (b) at least one second dye, the principal colour density of which corresponds to a secondary colour density, which is to be compensated, of the first dye, and an iodide ion-free silver halide emulsion being present in a further layer, (c) a further layer, adjacent to the layer (b), containing colloidal nuclei capable of depositing metallic silver from soluble silver complexes, if appropriate an insensitive, not spectrally sensitized iodide-free silver halide emulsion and, if appropriate, a development inhibitor, and (d) a separating layer being present between the layers(a) and (c), and the developer solution, with which the material is treated, containing a complex former which is capable of producing water-soluble and diffusible silver complexes, wherein the developer solution contains 0.3 to 1.0 mol/l of a bromide as the complex former.

The present invention also relates to the developer solution which can be used in the process according to the invention and contains 0.3 to 1.0 mol/l of a bromide.

The substance which is associated with another substance, is here understood to mean those substances which belong to the same layer or to two adjacent layers of a photographic silver dye bleach material and can undergo mutual interaction.

According to the process described, a number of different masking effects can be achieved. Depending on the arrangement of the layers in the overall layer pack, it is then possible that one or two secondary colour densities are compensated by one image dye or that one secondary colour density is compensated by each of two image dyes.

Furthermore, those layer arrangements are possible, for example, in which two iodide-free emulsion layers and one iodide-containing emulsion layer are combined with only one nuclei layer in such a way that only one secondary colour density is compensated in each case by one colour layer.

Preferably, the spectral sensitivity of the silver halide emulsions coincides with the principal absorption maximum of the image dye associated therewith.

The general case is that in which the dye and the associated emulsion sensitized for the colour complementary to the primary colour are in the same layer. These associated components can, however, also be at least partially in a layer adjoining the dye layer.

In these layers, one of the two components, image dye and sensitized silver halide emulsion, is then only partially present or not at all. Such layer arrangements have been described, for example, in DE-A Nos. 2,036,918, 2,132,835 and 2,132,836. They serve especially for influencing the gradation, which is relatively steep in silver dye bleach materials, or for increasing the sensitivity. However, this results in a restriction for the layer which contains that dye of which the principle colour density corresponds to a secondary colour density to be masked, as can already be seen from the above circumscription of the material: the iodide-free silver halide emulsion associated with this dye must be provided in the layer itself, i.e. as near as possible to the associated dye. It is also possible, however, to associate this latter dye in an adjacent layer with yet an additional emulsion layer which, in this case, must be located on the dye layer side opposite to the nuclei-containing layer.

This additional emulsion layer is then preferably also iodide-free or, if desired, can also contain a small quantity of iodide ions, whereby the intensity of the desired masking effect can be controlled. Moreover, it is possible also to select, for the emulsions associated with the individual dye layers, spectral sensitivities other than those in the particular complementary colour. Such variants suitable for the assembly of so-called false-colour films have been described, for example, in DE-A No. 2,132,835.

Silver dye bleach materials for the reproduction of coloured originals are in general trichromatic and contain three colour layers, one each in the subtractive primary colours yellow, magenta and cyan. To obtain special effects, however, materials with other colours or with only two colour layers can be used. Moreover, the yellow, magenta and cyan dyes known per se for this purpose can be used as image dyes in combination with the matching spectral sensitizers.

The light-sensitive silver halide emulsions normally used are those which contain silver chloride, silver bromide or silver iodide or mixtures of these halides. Iodide-containing silver halide emulsions normally contain between 0.1 and 10 mol percent of silver iodide, the remainder consisting of silver chloride and/or silver bromide (for example 0 to 99.9 mol percent of silver chloride and 0 to 99.9 mol percent of silver bromide). Iodide-free silver halide emulsions preferably contain silver chloride, silver bromide or a silver chloride/silver bromide mixture. The iodide-free silver halide emulsions of the nuclei layer are not sensitized.

Gelatine is normally used as the protective colloid for producing these emulsions; however, other water-soluble protective colloids such as polyvinyl alcohol or polyvinyl pyrrolidon and the like can also be used; moreover, a part of the gelatine can be replaced by dispersions of water-insoluble high-molecular substances. For example, the use of dispersion polymers of $\alpha,\beta$-unsaturated compounds, such as acrylate esters, vinyl esters, vinyl ethers, vinyl chloride, vinyliden chloride, and of other mixtures and copolymers is usual.

Examples of suitable colloidal nuclei for the deposition of metallic silver from silver complex compounds are colloidal hydrosols of noble metals, such as gold, silver or palladium, and also metal sulfides such as nickel sulphide or silver sulphide. Since these nuclei have to be introduced in only a very small quantity, for example 1 mg to 200 mg per $m^2$, no interference by light absorption or light scattering is generally to be feared. However, preferably those nuclei are introduced into the layer which can be removed again at a later stage, for example during the processing method. A hydrosol of colloidal silver, which can readily be removed again from the material during the silver dye bleach process, is particularly suitable for this purpose. The yellow silver hydrosol, which can be incorporated directly below the yellow dye layer into a yellow filter layer intended for absorbing blue radiation, is particularly suitable.

If metallic silver deposits on the nuclei during development in the presence of a silver complex former, it must be ensured that, during the subsequent dye bleach, this metallic silver acts only in the desired direction, i.e. on the colour layer in which the dye is present together with the preferably iodide-free silver halide emulsion. It is therefore necessary to provide a barrier layer or separating layer opposite the further colour layers, the secondary colour density of which is to be masked and which are associated with an iodide-containing silver halide emulsion. Such a separating layer consists in general of pure binder, for example gelatine, and contains neither a dye nor silver halide emulsion. However, if it is advantageous for the overall layer assembly, an already present emulsion layer or a filter layer, for example, can also serve as the separating layer, if appropriate. In addition to the gelatine, the separating layer can also contain further additives, such as substances, which inhibit the dye bleach, additional binders, for example water-soluble colloids or even water-insoluble dispersion polymers, and also the additives usual for the assembly of photographic layers, such as plasticizers, wetting agents, light stabilizers, filter dyes or hardeners.

Suitable development inhibitors are the sulfur-containing compounds, known as anti-fogging agents, from one of the following classes: aliphatic sulfur compounds, mercaptothiazolium salts, mercaptotriazolium salts, mercaptotetraazaindenes, mercaptotetrazoles and, if appropriate, further compounds, the silver salts of which have a solubility between that of silver bromide and silver sulfide. These development inhibitors are bound by absorption, in a manner resistant to diffusion, to the particles of the non-sensitized, iodide-free silver halide emulsion of layer (c).

The following compounds are particularly suitable as stabilizers: cysteine, 2-mercaptobenzothiazole, N-methylmercaptotriazole and phenylmercaptotetrazole, the latter being preferred.

The insensitive emulsion used, which is located in the nuclei layer, can be a fine-grain emulsion which consists of silver chloride, silver bromide or silver chlorobromide and which in general is not spectrally sensitized and is so insensitive that no developable grains which could interfere with image production are formed during an exposure, under which the light-sensitive emulsions of the other layers are exposed up to saturation.

If a silver chlorobromide emulsion is used, the silver chloride content is about 10–90 mol-%, preferably 30–70 mol-%, and the emulsion should preferably be iodide-free.

The mean grain diameter is in general about 0.05 μm to 1.2 μm, preferably 0.4 μm to 0.8 μm.

As already mentioned, the exposed silver halide layers are developed in the presence of bromide as a silver complex former, i.e. an anion which is capable of forming water-soluble diffusible complexes with silver ions. One liter of developer solution should contain between 0.3 and 1.0 mol of a bromide, preferably an inorganic bromide, for example sodium bromide, potassium bromide and ammonium bromide, the optimum quantity being variable depending on the nature of the material, the temperature of the developing bath and the desired duration of action, within the indicated limits.

A particularly advantageous concentration range is between 0.50 and 0.75 mol/l. Preferably, potassium bromide is used.

The examples which follow illustrate the invention without restricting it thereto.

EXAMPLE 1

A material for the silver dye bleach process, suitable for producing positive prints, to be viewed in reflected light, from a positive original, is prepared in the following way:

The following layers are applied in the indicated order to a white-opaque base:

1. A cyan layer which contains 0.155 g/m² of the cyan dye of the formula

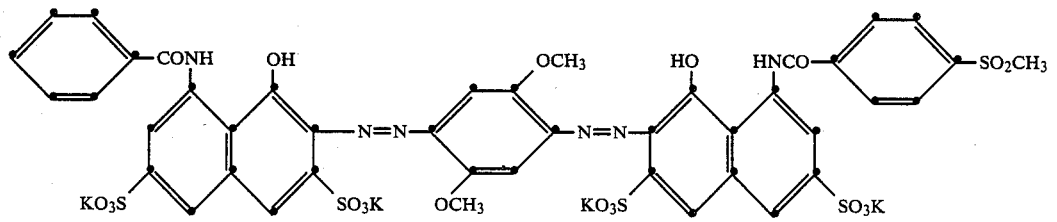

(100)

1.9 g/m² of gelatine and 0.140 g of silver as a red-sensitive silver bromoiodide emulsion with 5.2 mol-% of iodide;

2. An emulsion layer which contains 1.8 g/m² of gelatine and 0.275 g/m² of silver as a red-sensitive silver bromoiodide emulsion with 5.2 mol-% of iodide;

3. An interlayer of 4.0 g/m² of gelatine;

4. A magenta layer which contains 0.183 g/m² of the magenta dye of the formula

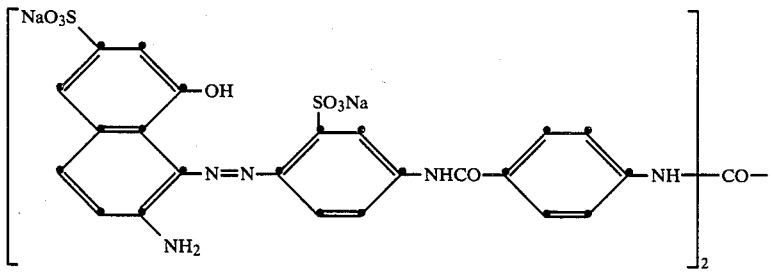

(101)

2.3 g/m² gelatine and 0.175 g/m² of silver as a green-sensitive silver bromoiodide emulsion with 5.2 mol-% of iodide;

5. An emulsion layer which contains 2.0 g/m² of gelatine and 0.30 g/m² of silver as a green-sensitive silver bromoiodide emulsion with 5.2 mol-% of iodide;

6. A masking layer which contains 3.75 g/m² of gelatine and 2 mg/m² of colloidal silver;

7. A yellow layer which contains 0.150 g/m² of the yellow dye of the formula

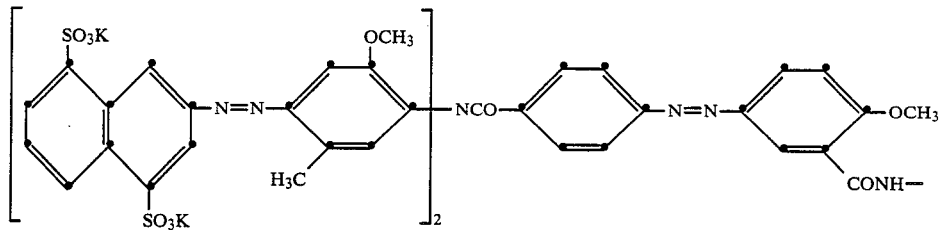

(102)

3.0 g/m² of gelatine and 0.42 g of silver as a blue-sensitive silver bromoiodide emulsion;

8. An emulsion layer which contains 1.86 g/m² of gelatine and 0.39 g/m² of silver as a blue-sensitive silver bromoiodide emulsion; and 9. A protective layer of 1.65 g/m² of gelatine. In addition, the material contains 0.48 g/m² of the hardener 2-amino-4-hydroxy-6-(4-methylmorpholinium)-1,3,5-triazine tetrafluoroborate.

The material is exposed behind a grey wedge individually in each case with one blue, green or red additive colour filter and in one case with all three filters (blue+green+red). The exposure times are adjusted such that, on superposition (blue+green+red) after processing, a grey wedge is formed which is as neutral as possible.

Processing is then carried out in accordance with the following instructions:

| | |
|---|---|
| development | 3 minutes |
| washing | 1 minute |
| silver and dye bleach | 3 minutes |
| washing | 1 minute |
| fixing | 3 minutes |
| washing | 3 minutes |
| drying | |

The temperature of the processing baths is 30° C.

The developer bath contains, per liter of solution, the following components:

| | |
|---|---|
| sodium ethylenediaminetetraacetate | 4.0 g |
| potassium sulfite | 19.9 g |
| sodium sulfite | 38.0 g |
| lithium sulfite | 0.6 g |
| hydroquinone | 8.0 g |
| phenidone Z | 0.5 g |
| potassium carbonate | 19.5 g |
| potassium bicarbonate | 13.3 g |
| benzotriazole | 1.0 g |
| potassium bromide | 40.0 g (0.033 M) |

The bleach bath has, per liter of solution, the following composition:

| | |
|---|---|
| sulfuric acid (100%) | 41.8 g |
| sodium m-nitrobenzenzenesulfonate | 7.5 g |
| Potassium iodide | 9.0 g |
| 2,3,4-trimethylquinoxaline | 1.1 g |
| Potassium salt of bis-cyanoethyl-sulfoethyl-phosphine | 2.9 g |

The fixing bath contains, per liter of solution:

| | |
|---|---|
| ammonium thiosulfate | 200.0 g |
| ammonium bisulfate | 6.9 g |

-continued

| | |
|---|---|
| ammonium sulfite | 17.9 g |

The colour densities of the four wedges obtained (blue, green, red and grey wedges) are measured by means of a density meter and, from these, the analytical colour densities of the three colour channels cyan (C), magenta (M) and yellow (Y) are calculated. The colour density curves, obtained in this way, of the various wedges are shown in FIGS. 1A to 1D, the density of the exposed grey wedge being indicated on the abscissa, and the colour densities in "Unity neutral normalized analytical densities" (UNNAD) being indicated on the ordinate, cf. A. J. Sant, Phot. Sci. En. 14, 356 (1970).

The masking effect can be expressed as the difference between the sensitivity of the yellow layer under grey exposure (blue+green+red) and the sensitivity of the yellow layer under blue exposure alone. It is 0.13 log. units at UNNAD 0.4.

When the same material is processed in a developer which does not contain any potassium bromide, the curves of FIGS. 2A to 2D are obtained. There is no masking effect. The sensitivity of the yellow layer under blue exposure is even 0.09 log. units less sensitive (at UNNAD 0.4) than the sensitivity under grey exposure.

EXAMPLE 2

The material according to Example 1 is exposed and processed as described there, but with the difference that the developer solution contains 60 g of potassium bromide per liter (0.50M/l). The difference between the sensitivity of the yellow layer under grey exposure and the sensitivity of the yellow layer under blue exposure alone is 0.24 log. units at UNNAD 0.4.

EXAMPLE 3

The material according to Example 1 is exposed and processed as described there, but with the difference that the developer solution contains 80 g of potassium bromide per liter (0.67M/l). The difference between the sensitivity of the yellow layer under grey exposure and the sensitivity of the yellow layer under blue exposure alone is 0.31 log. units at UNNAD 0.4.

EXAMPLE 4

The material according to Example 1 is exposed and processed as described there, but with the difference that the developer solution contains 100 g of potassium bromide per liter (0.84M/l). The difference between the sensitivity of the yellow layer under grey exposure and the sensitivity of the yellow layer under blue exposure alone is 0.25 log. units at UNNAD 0.4.

EXAMPLE 5

If the material according to Example 1 is treated with the developer solutions which are described in DE-A Nos. 2,547,720 and 2,831,814 and additionally contain 2.0 g/l of potassium bromide, a masking effect of the same intensity as in example 3 is admittedly obtained, but all the disadvantages associated with the formation of silver sediment must be accepted.

What is claimed is:

1. A process for producing masked positive colour images by the silver dye bleach process by exposure, development, dye bleaching, silver bleaching and fixing, with the use of a photographic material which, in each of at least two layers, contains a dye which can be bleached imagewise and the absorption maximum of which corresponds in each case to one of the three principal colours red, green and blue, each dye being associated with a silver halide emulsion layer sensitive in a defined spectral region and, in this material, (a) the dye, the undesired secondary colour density of which is to be compensated, being associated with a silver halide emulsion layer consisting at least partially of silver iodide, (b) at least one second dye, the principal colour density of which corresponds to a secondary colour density, which is to be compensated, of the first dye, and an iodide ion-free silver halide emulsion being present in a further layer, (c) a further layer, adjacent to the layer (b), containing colloidal nuclei capable of depositing metallic silver from soluble silver complexes, if appropriate an insensitive, not spectrally sensitized iodide-free silver halide emulsion and, if appropriate, a development inhibitor, and (d) a separating layer being present between the layers (a) and (c), and the developer solution, with which the material is treated, containing a complex former which is capable of producing water-soluble and diffusible silver complexes, wherein the developer solution contains 0.3 to 1.0 mol/l of a bromide as the complex former.

2. The process according to claim 1, wherein the spectral sensitivity of the silver halide emulsions coincides with the principal absorption maximum of the image dye associated therewith.

3. A process according to claim 1, wherein a trichromatic material is used which contains a cyan dye, a magenta dye and a yellow dye as an image dye in one layer in each case.

4. A process according to claim 1, wherein the silver halide emulsion associated with the individual image dyes are in the same layer as the associated image dyes or at least partially in a layer adjacent to the dye layer.

5. A process according to claim 1, wherein one or two secondary colour densities are compensated by one image dye of a multi-layer material.

6. A process according to claim 1, wherein one secondary colour density is compensated by each of two image dyes of a multi-layer material.

7. A process according to claim 1, wherein the silver iodide-containing emulsion layer contains 0.1 to 10 mol-% of silver iodide.

8. A process according to claim 1, wherein the nuclei capable of depositing metallic silver consist of colloidal silver.

9. A process according to claim 1, wherein between 0.3 and 1.0 mol/l of potassium bromide, sodium bromide or ammonium bromide is used in the developer solution.

10. A process according to claim 9, wherein between 0.50 and 0.75 mol/l of potassium bromide, sodium bromide or ammonium bromide are used in the developer solution.

11. A developer solution which is suitable for carrying out the process according to claim 1 and contains 0.3 to 1.0 mol/l of a bromide.

* * * * *